US007300015B2

(12) United States Patent
Fukushima et al.

(10) Patent No.: US 7,300,015 B2
(45) Date of Patent: Nov. 27, 2007

(54) PAPER MAGAZINE

(75) Inventors: Kimitake Fukushima, Kanagawa (JP); Junichi Kurumisawa, Saitama (JP)

(73) Assignee: Fujifilm Corporation, Tokyo (JP)

( * ) Notice: Subject to any disclaimer, the term of this patent is extended or adjusted under 35 U.S.C. 154(b) by 27 days.

(21) Appl. No.: 11/159,330

(22) Filed: Jun. 23, 2005

(65) Prior Publication Data

US 2005/0284975 A1 Dec. 29, 2005

(30) Foreign Application Priority Data

Jun. 24, 2004 (JP) ..... 2004-186529

(51) Int. Cl.
*B65H 49/34* (2006.01)

(52) U.S. Cl. ..... 242/564.3; 242/348.3

(58) Field of Classification Search ..... 242/348, 242/348.3, 348.4, 342, 588.5, 538.4, 564.5, 242/542.3, 535.4; 355/72; 400/242, 244; 226/171, 172

See application file for complete search history.

(56) References Cited

U.S. PATENT DOCUMENTS 3,117,741 A * 1/1964 Chase et al.
4,111,379 A * 9/1978 Luscher
4,690,344 A * 9/1987 Yokota
4,928,897 A * 5/1990 Satou et al.
5,758,840 A * 6/1998 Murakami
5,979,820 A * 11/1999 Yamada et al.
6,089,487 A * 7/2000 Imai et al.
6,161,795 A * 12/2000 Skerrett et al.
6,196,493 B1 * 3/2001 Tanaka
6,244,530 B1 * 6/2001 Imai et al.

FOREIGN PATENT DOCUMENTS

JP 7-114108 A 5/1995

* cited by examiner

*Primary Examiner*—William A. Rivera
(74) *Attorney, Agent, or Firm*—Birch, Stewart, Kolasch & Birch, LLP

(57) ABSTRACT

A paper magazine to be loaded in an image recording device contains a roll of recording paper, and is provided with a transport mechanism to feed the recording paper out of the paper magazine with holding a leading end of the recording paper. The transport mechanism includes a drive roller and a belt mechanism. The belt mechanism is composed of a pair of pulleys, separated by a particular interval, and a flat belt to encircle the pulleys. The drive roller contacts with the flat belt in the center, pressing it to bend. Making surface contact with the recording paper between the flat belt, the drive roller transports the recording paper without slipping.

17 Claims, 5 Drawing Sheets

PAPER MAGAZINE

BACKGROUND OF THE INVENTION

1. Field of the Invention

The present invention relates to a paper magazine for image recording devices such as printers.

2. Background Arts

A printer for printing an image of a negative film on a photosensitive material such as photographic papers generally pre-loads a paper magazine, which contains a roll of photosensitive material wound around a paper tube. The photosensitive material is drawn from the paper magazine, cut into an intended size, and transported to a printing section. The photosensitive material with an image printed is sent to a subsequent developing apparatus.

This kind of paper magazine is disclosed in the Japanese patent laid-open publication No. 07-114108, in which the paper magazine has a drive roller rotated by a drive source in the printer main body and a nip roller facing the drive roller to nip the photosensitive material therebetween so as to transport the photosensitive material.

In order to improve a transport stability, the nip roller may nip the photographic paper with high pressure. However, the high nip pressure possibly causes pressure-induced fog or bears nip impressions on the photosensitive material. This problem may be solved by a paper magazine with several pairs of nip rollers, which can reduce the pressure from individual nip rollers while providing sufficient degree of nip pressure in its entirety. Meanwhile, the paper magazine of the Japanese patent laid-open publication No. 07-114108 has a pair of nip rollers to steadily transport the photosensitive material.

To change the size of the photosensitive materials, the above described printers require a replacement of the paper magazine itself with another containing the photosensitive material of the intended size. If a leading end of the photosensitive material remains out of the paper magazine during the replacement, the leading end will be exposed. This is the reason the drive roller is rotated backwards as the print operation completes, rewinding the photosensitive material back in the paper magazine to protect the photosensitive material from exposure during the replacement.

Since the drive roller and the nip roller always stay in line contact with the photosensitive material in the width direction thereof, leaving the paper magazine unused for a long time will result in bearing a linear impression on the leading end of the photosensitive material. In addition, one or both of these rollers may be deformed because these rollers have soft, rubber-made surfaces. Long-term use of the paper magazine, at the same time, will have an affect on the drive roller and the nip roller to decrease frictional resistance in some part of their surfaces due either to adhesion of paper dust from the photosensitive material, deformation of the roller surface as described above, and degradation of the surface materials. This condition fluctuates feeding force of the drive roller and leads to an error in feed length of the photosensitive material, causing some disadvantages such as unsuccessful setting of the photosensitive material in a cutting position. Further, the drive roller and the nip roller are disposed to nip the side edges of the photographic paper, and such a configuration produces a significant amount of paper dust from the side edges and therefore aggravates the above described disadvantages.

SUMMARY OF THE INVENTION

In view of the foregoing, a primary object of the present invention is to provide a paper magazine which ensures accurate, long-term feed length control to a recording paper while preventing a drive roller from deforming in the surface. Another object of the present invention is to provide the paper magazine which keeps frictional resistance on the surface of the drive roller by preventing generation of paper dust.

To achieve the above objects and other objects of the present invention, the paper magazine includes a plurality of pulleys which is separated by particular intervals, a belt which is wound around the plurality of pulleys, and a drive roller which is rotated by driving force from either the inside or the outside of the paper magazine. A surface of the drive roller and an outer surface of the belt between the pulleys come into pressure contact with the recording paper. The belt is driven by the rotation of the drive roller. Any type of belt such as a rubber belt or a leather belt can be employable as long as it is made from an elastic material. Preferable is a flat belt if the pulleys have a roller shape, however, a synchronous belt or a V belt can also be used. In this case, the pulleys will be synchronous or provided with V shape grooves.

It is possible to employ a number of belts and drive rollers aligned in the width direction of the recording paper. The belts and the drive rollers should , in this case, lie within the width of the recording paper and not to reach the width directional side edges of the recording paper in order to prevent generation of paper dust.

Tension on the belt is determined by the interval between the pulleys, a diameter of the pulleys, and a perimeter of the belt. The tension, in fact, may gradually decreases as the belt is deteriorating and stretching in a long-term use. It is therefore preferable to provide a tension applying mechanism, which imparts the tension of the belt to at least one of the pulleys.

According to the present invention, the drive roller makes pressure contact with the periphery of the belt between the plurality of pulleys. The belt partly sticks fast a periphery of the drive roller in an arc, and the drive roller makes surface contact with the recording paper. This posture stables the pressing force of the drive roller, ensuring even pressure contact and consequently improving the paper feed accuracy. At the same time, the surface contact can minimize the chance of bearing the nip impressions on a leading end of the recording paper even if the paper magazine is left unused for a long time. The present invention employs an endless circulating belt, which requires no guide plates for the belt. An embodiment where the belt and the drive roller are arranged not to reach the both ends (or side edges) of the recording paper will effectively reduce the generation of paper dust, and the feeding force (i.e. the frictional resistance) is thereby maintained at proper level.

BRIEF DESCRIPTION OF THE DRAWINGS

The foregoing and other features and advantages of the present invention will become apparent from the following detailed descriptions of the preferred embodiments in conjunction with the accompanying drawings, which are given by way of illustration only and thus do not limit the present invention. In the drawings, the same reference numerals designate like or corresponding parts throughout the several views, and wherein.

DESCRIPTION OF THE PREFERRED EMBODIMENTS

Figure 1:
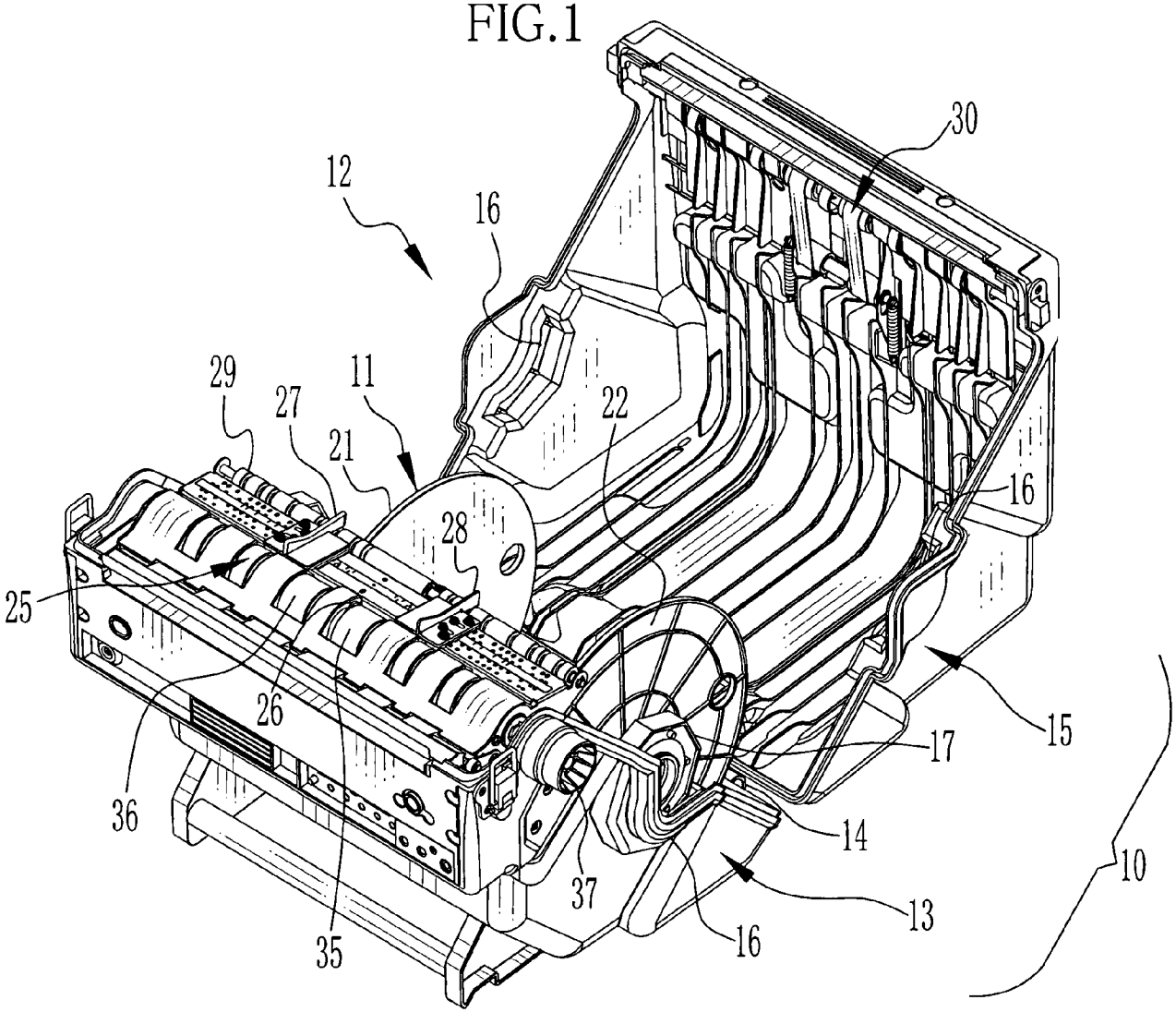
FIG. 1 is a perspective view of a paper magazine with a lid being lifted.
Figure 2:
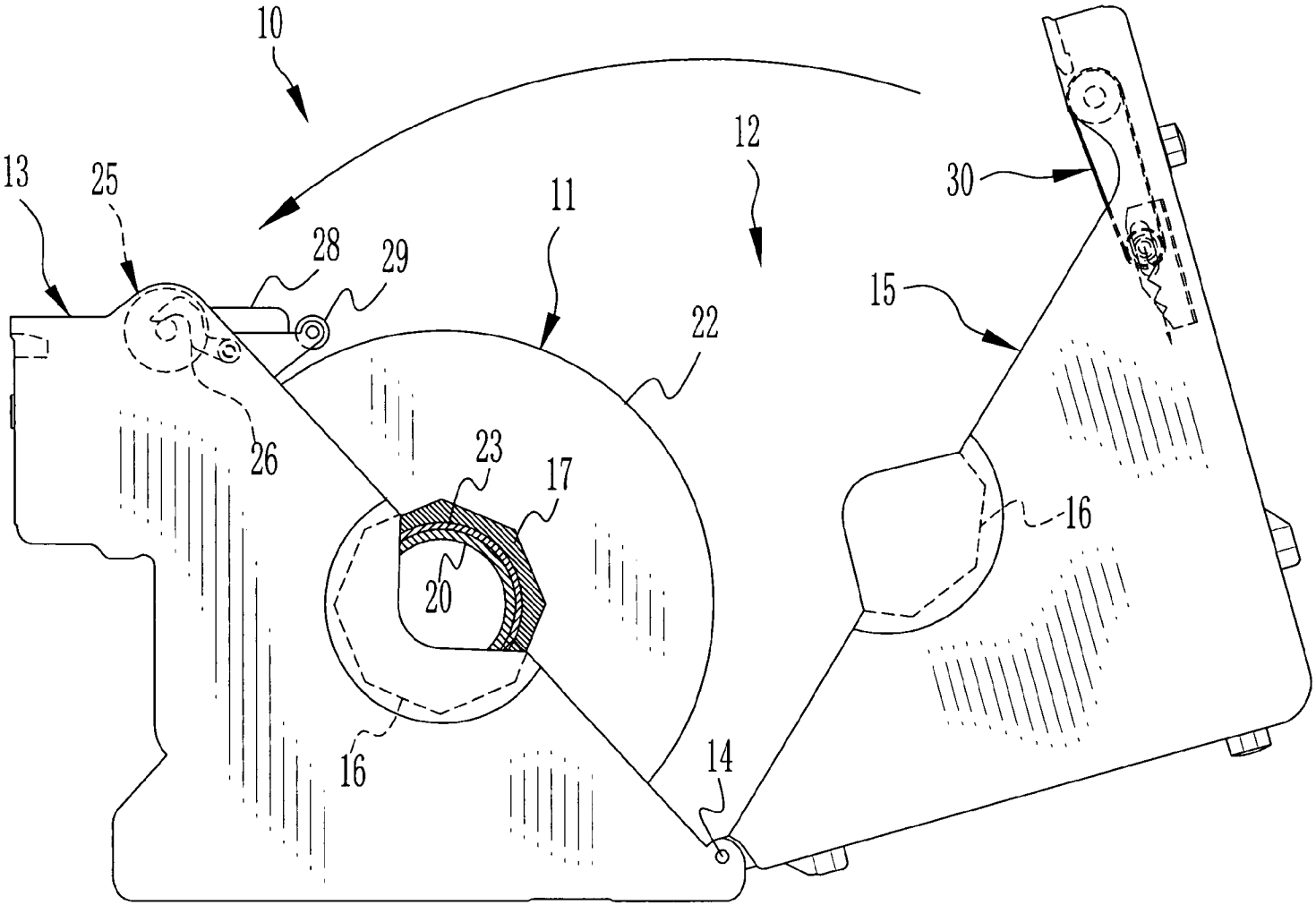
FIG. 2 is a side view of the paper magazine with the lid being lifted.

Referring now to FIG. 1 and FIG. 2, a paper magazine 10 is composed of a magazine main body 13, which can load a winding core 11 supporting a photosensitive material roll (not shown) from an open section 12, and a lid 15 attached to one end of the magazine main body 13 through a hinge 14. The lid 15 rotates on the hinge 14 to close the open section 12.

In the magazine main body 13 and the lid 15, bearings 16 are provided to hold both ends of the winding core 11. The bearings 16 have an octagonal shape to fit onto holders 17 on the both ends of the winding core 11, and thereby the holders 17 are unrotatably caught in the bearings 16 when the winding core 11 is set in the paper magazine 10.

The winding core 11 is includes a roll core 20 and a pair of flanges 21, 22. The flanges 21, 22 hold the photosensitive material roll while positioning the center of the photosensitive material in the width direction to the center of a transport passage in the paper magazine 10. The holders 17 are rotatably attached to the both ends of the roll core 20. Provided between the holder 17 and the roll core 20 is a friction member 23 such as felt, which produces some friction when the roll core 20 rotates in the holders 17. Therefore the winding core 11 is not able to rotate in the paper magazine 10 unless a certain degree of torque is applied thereto, and unexpected rotation of the winding core 11 will be prevented. Note that the photosensitive material is wound on the periphery of the roll core 20 between the flanges 21, 22.

The magazine main body 13 is provided with a drive roller unit 25, a detection lever 26, a pair of guide members 27, 28, and a roller assembly 29. Displaceable in the width direction of the photosensitive material, the pair of guide members 27, 28 can be rearranged according to the size of the photosensitive material so that the interval between them can fit to the width of a photosensitive material to be used. In the lid 15, a driven belt unit 30 is provided.

Figure 3:
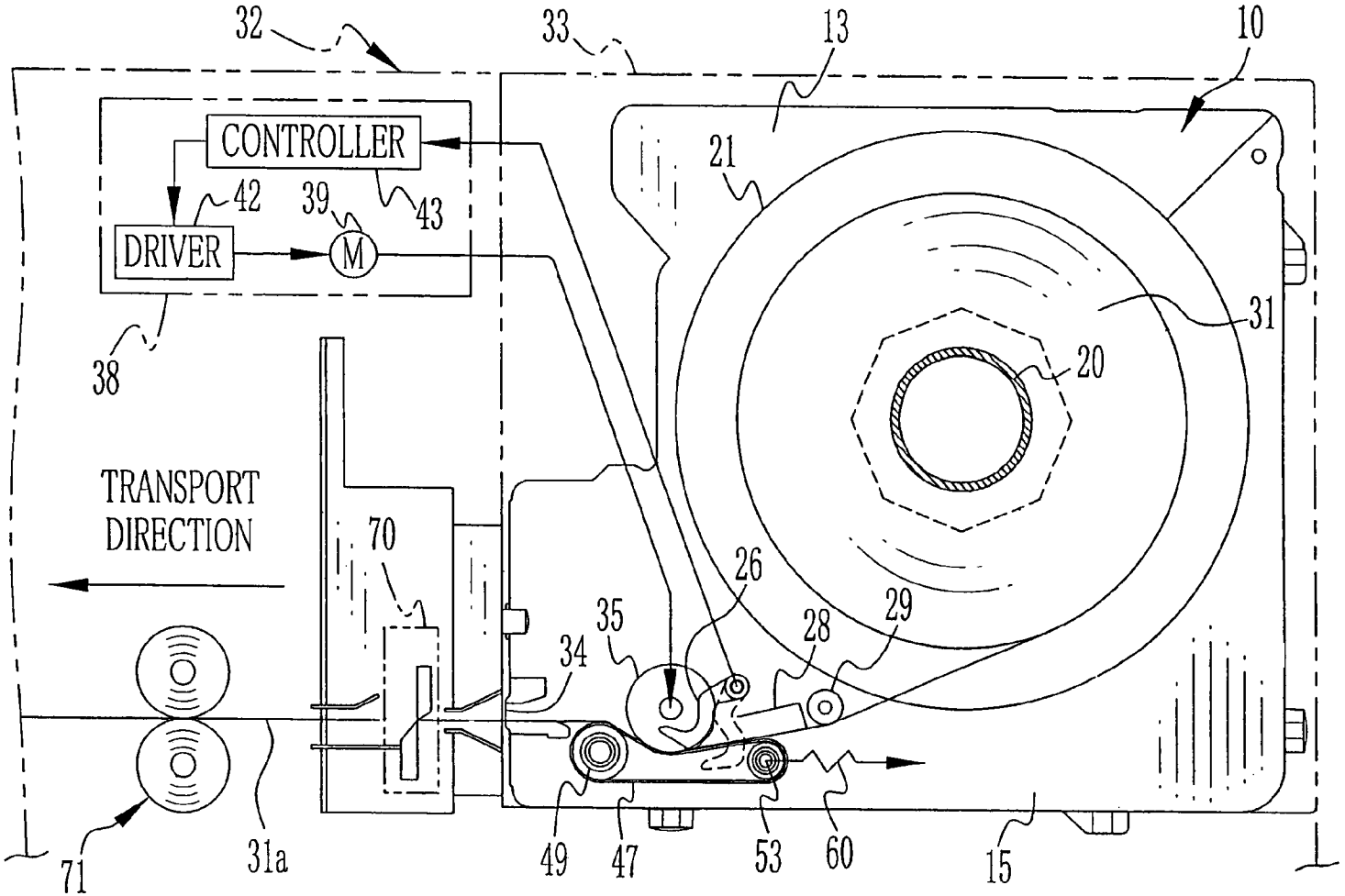
FIG. 3 is an explanatory view of the paper magazine mounted in an image recording apparatus.

In FIG. 3, the paper magazine 10 is mounted in a loading chamber 33 of an image recording device 32 with the magazine main body 13 facing up and the lid 15 down. Guided by the roller assembly 29 between the flanges 21, 22 while regulated by the guide members 27, 28 in the width direction, a photosensitive material 31 passes between the drive roller unit 25 and the driven belt unit 30. The photosensitive material 31 is fed to the image recording device 32 through an opening 34 formed across joint portions of the unit body 13 and the lid 15.

The magazine main body 13 is provided with a shutter mechanism (not shown), which blocks light coming inside the paper magazine 10 through the opening 34. The shutter mechanism is composed of a mount detective pin and a shutter member which opens the transport passage for the photosensitive material 31 inside the opening 34 in response to a displacement of the mount detective pin. The shutter member is usually set in a closed position by the bias of a spring, blocking the incoming light from the opening 34 to the inside of the paper magazine 10. When the paper magazine 10 is mounted in the loading chamber 33 such that the opening 34 faces the transport passage for the photosensitive material 31 in the image forming apparatus, the mount detective pin is pushed and displaced to move the shutter member to an open position. The photosensitive material 31 will consequently be transferred from and into the opening 34. Formed to project within a concave portion, the mount detective pin will hardly be pushed and displaced outside the image recording apparatus. The shutter member, in addition, will block the incoming light to the inside of the paper magazine 10 even on the move to the open position when the paper magazine 10 is completely mounted in the loading chamber 33. The shutter mechanism may have a solenoid or a motor, instead of the displaceable mount detective pin, to open and close the shutter member.

Figure 4:
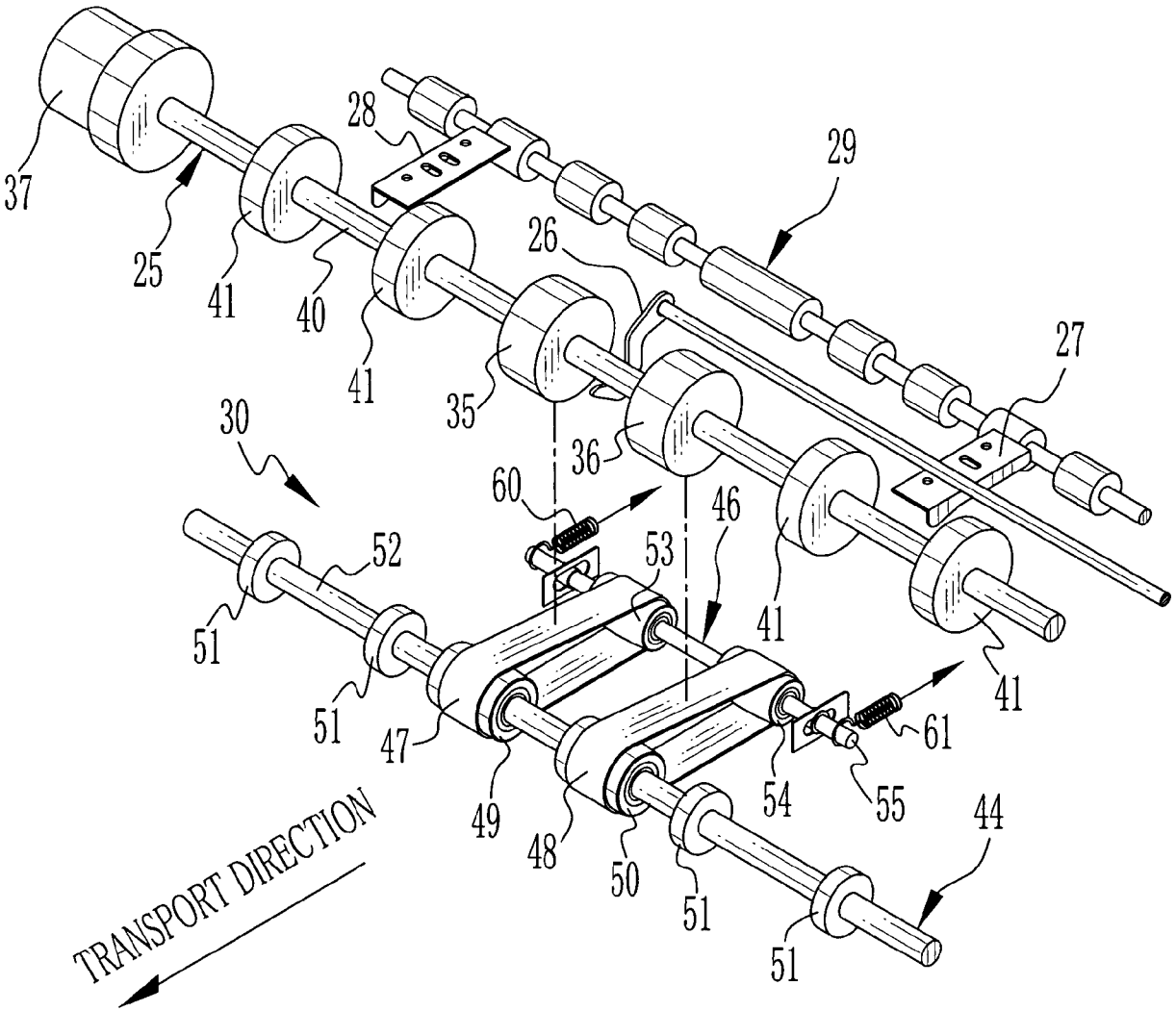
FIG. 4 is a perspective view schematically illustrating key components of a drive roller unit and a driven belt unit.

As shown in FIG. 4, the drive roller unit 25 is constituted of a pair of drive rollers 35, 36 and a joint section 37 (see FIG. 1) at one end of a shaft 40 of these rollers. Disposed outside the paper magazine 10, the joint section 37 couples with a driver mechanism 38 in the image recording device 32 when the paper magazine 10 is mounted in the loading chamber 33. The driver mechanism 38, as shown in FIG. 3, is provided with a pulse motor 39, a driver 42, and a controller 43 for the drive rollers 35, 36. The controller 43 controls the forward/backward rotations and the stop of the drive rollers 35, 36.

As shown in FIG. 4, the drive roller unit 25 includes of a pair of drive rollers 35, 36 and a joint section 37 (see FIG. 1) at one end of a shaft 40 of these rollers. Disposed outside the paper magazine 10, the joint section 37 couples with a driver mechanism 38 in the image recording device 32 when the paper magazine 10 is mounted in the loading chamber 33. The driver mechanism 38, as shown in FIG. 3, is provided with a pulse motor 39, a driver 42, and a controller 43 for the drive rollers 35, 36. The controller 43 controls the forward/backward rotations and the stop of the drive rollers 35, 36.

The detection lever 26 can rotate between a projecting position into the transport passage of the photosensitive material 31 and a retreating position away from the transport passage. The detection lever 26 stays in the retreating position when the photosensitive material 31 lies in the transport passage, but moves in the projecting position as soon as the photosensitive material 31 runs out. Running out of the photosensitive material 31 is therefore easily determined by detecting the position of the detection lever 26. The position detection is made by a sensor in the image recording device 32. The sensor outputs signals to the controller 43 in the driver mechanism 38, and thereby the rotation of the pulse motor 39, eventually of the drive rollers 35, 36, is thereby controlled. The sensor outputs signals to the controller 43 in the driver mechanism 38, and thereby the rotation of the pulse motor 39, eventually of the drive rollers 35, 36, is thereby controlled.

As shown in FIG. 4, the drive roller unit 25 has a number of rubber rollers, which are fixed to the shaft 40 with a certain interval between them. These rubber rollers are symmetrically arranged about a center of the transport passage in the width direction. The innermost pair is the drive rollers 35, 36 while the rests are sub drive rollers 41. On one end of the shaft 40, the joint section 37 is fixed. The detection lever 26 is placed between the drive rollers 35, 36. The guide members 27, 28 are disposed upstream of the drive rollers 35, 36 in a transport direction of the photosensitive material 31, and the roller assembly 29 is disposed upstream of the guide members 27, 28.

The driven belt unit 30 includes a first pulley unit 44, a second pulley unit 46, a pair of flat belts 47 ,48, and a pair of coil springs 60, 61 as the tension applying mechanism of the present invention. The first pulley unit 44 has a pair of first pulleys 49, 50 and a number of driven rollers 51 on a shaft 52. The first pulleys 49, 50 are crown shaped rollers, with their centers swelling like a barrel, to prevent the flat belts from leaning on one side. The first pulleys 49, 50 are also symmetrically arranged about the center of the transport passage in the width direction so as to correspond in position to the drive rollers 35, 36. The first pulleys 49, 50 are provided with roller bearings toward the shaft 52, and rotatable on the shaft 52 consequently. The driven rollers 51 are equal in number to the sub drive rollers 41, and are separately arranged to face their corresponding sub drive rollers 41. Being rotatable on the shaft 52, the driven rollers 51 act as guide rollers, which prevent the side edges of the photosensitive material from clogging in the paper magazine even when a wide photosensitive material is used. The shaft 52 is rotatably supported on the lid 15.

The second pulley unit 46 is disposed upstream of the first pulleys 49, 50 in the transport direction, and is composed of a pair of second pulleys 53, 54 and a shaft 55 for supporting these second pulleys. The second pulleys 53, 54 are also crown shaped rollers, with their centers swelling like a barrel, to prevent the flat belts from leaning on one side. The second pulleys 53, 54 are symmetrically arranged about the center of the transport passage in the width direction. Further, the second pulleys 53, 54 are provided with roller bearings toward the shaft 55, and rotatable on the shaft 55 consequently. The shaft 55 is rotatably supported on the lid 15.

Figure 5:
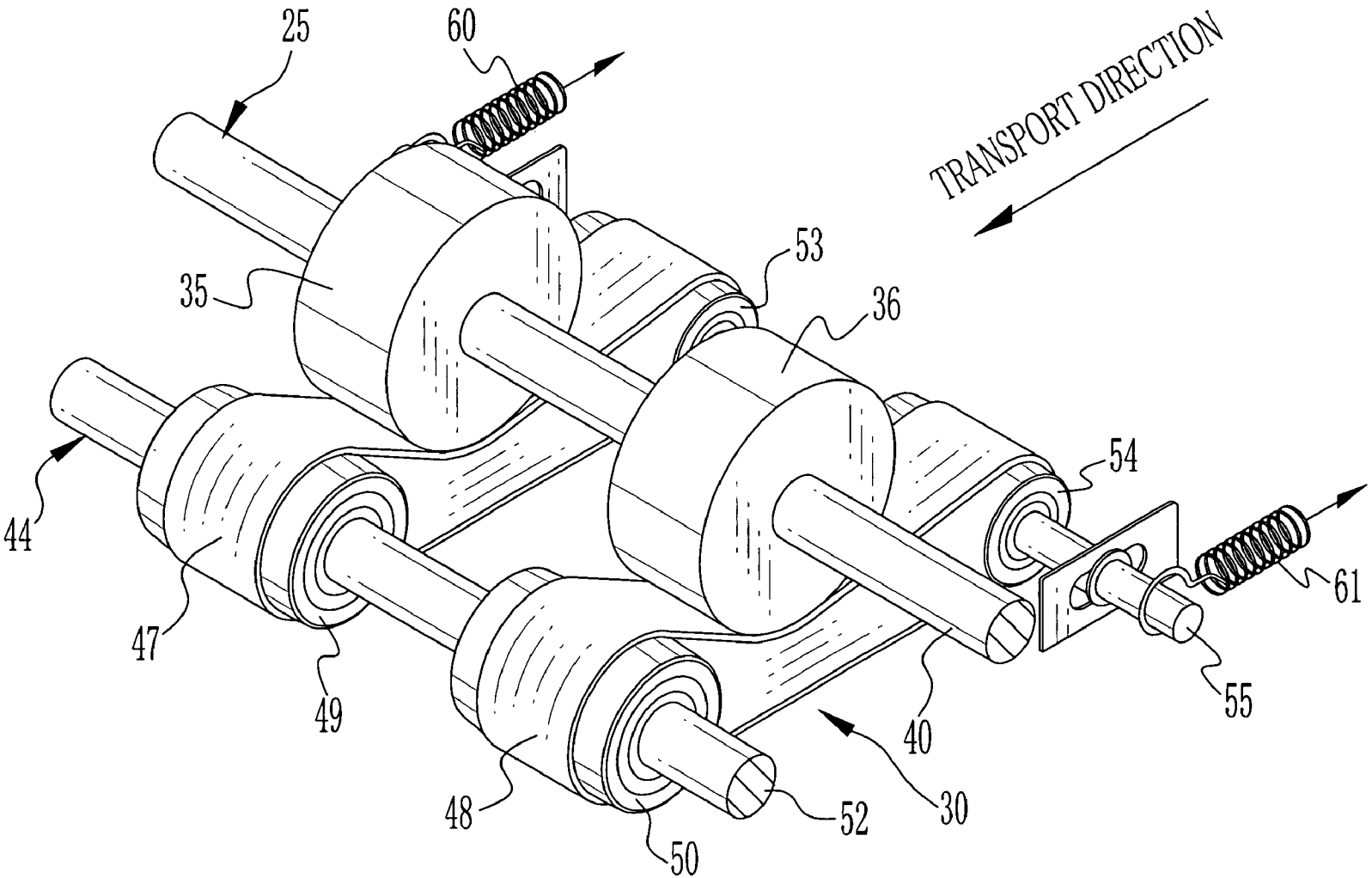
FIG. 5 is a perspective view illustrating the drive roller in pressure contact with a flat belt.

The flat belt 47 encircles the first and second pulleys 49, 53 while the flat belt 48 encircles the first and second pulleys 50, 54. As shown in FIG. 5, the drive rollers 35, 36 contact with the peripheries of flat belts 47, 48 respectively, in avoiding the contact area of the flat belts to the first and second pulleys, between the first pulley unit 44 and the second pulley unit 46. The shaft 55 for supporting the second pulleys 53, 54 is biased by springs 60, 61 to move in a direction away from the first pulleys 49, 50, that is, the opposite direction to the transport direction (or a rewind direction of the photosensitive material).

The force of the springs puts a certain amount of tension on the pair of flat belts 47, 48, and the pressure contact of the drive rollers 35, 36 will thus cause the flat belts 47, 48 to bend as the lid 15 is pressed down to the magazine main body 13. Since the springs 60, 61 expand and contract to keep the tension on the flat belts 47, 48 within a proper range, the pressure of the drive rollers 35, 36 on the flat belts 47, 48 is always fairly constant even if the pressure of the lid 15 is changed on the unit body 13.

There are several width to the photosensitive material 31. The position of the drive rollers 35, 36 and the flat belts 47, 48 is therefore determined with reference to the narrowest type photosensitive material. The drive rollers 35, 36 and the flat belts 47, 48 are arranged within the width of the photosensitive material and not to reach the side edges of the photosensitive material in the width direction. Such an arrangement can reduce the chance of generation of paper dust from the photosensitive material 31.

Described next is the operation of the above configuration, which starts with loading the photosensitive material 31 in the paper magazine 10. With the unit body 13 down, the lid 15 is lifted to unload the winding core 11. The flanges 21, 22 are temporarily detached from the winding core 11, and after the photosensitive material 31 is set to the roll core 20, they are attached to the winding core 11 again. The winding core 11 with the photosensitive material 31 is then placed in the magazine main body 13 and, a leading end of the photosensitive material 31 is pulled out through the roller assembly 29 to beyond the drive rollers 35, 36. As the lid 15 is being closed, the leading end of the photosensitive material 31 is held between the drive rollers 35, 36 and the flat belts 47, 48.

The prepared paper magazine 10 is mounted in the loading chamber 33 of the image recording device 32. Achieved on this loading operation are electrical and mechanical connections of the paper magazine 10 to the image recording device 32, drive control of the joint section 37 by the driver mechanism 38 in the image recording device 32, and positional detection of the detection lever 26 by the sensor of the image recording device 32.

As soon as the paper magazine 10 is mounted in the loading chamber 33, the image recording device 32 automatically performs a pre-cut operation to the leading end of the photosensitive material 31 as follows. The driver mechanism 38 of the image recording device 32 rotates the drive rollers 35, 36 in the transport direction, carrying the leading end of the photosensitive material 31 to the opening 34. Since the drive rollers 35, 36 press the flat belts 47, 48 to bend, the flat belts 47, 48 partly encircle the peripheries of the drive rollers 35, 36 like an arc, and the photosensitive material 31 makes surface contact with the drive rollers 35, 36. The surface contact pressure is fairly constant even with some factors on the peripheries of the drive rollers 35, 36 to reduce the frictional resistance, the photosensitive material 31 is therefore transported accurately. In addition, the expansion and contraction of the springs 60, 61 move the shaft 55 of the second pulleys 53, 54 to change the distance from the first pulleys 49, 50, and thereby the tension on the flat belts 47, 48 is maintained within a proper range.

As shown in FIG. 3, the image recording device 32 includes a cutter mechanism 70 on the transport passage of the photosensitive material 31. In the pre-cut operation, the driver mechanism 38 operates the drive rollers 35, 36 to rotate forward until the leading end of the photosensitive material 31 passes over the cutter mechanism 70, and the cutter mechanism 70 cuts out an excess portion of the leading end of the photosensitive material 31. Then, the driver mechanism 38 operates the drive rollers 35, 36 to rotate backward until the leading end of the photosensitive material 31 arrives at a return position anywhere between the cutting position of the cutter mechanism 70 and the pressure contact area of the drive rollers 35, 36 to the flat belts 47, 48.

The leading end of the photosensitive material 31 passes over the detection lever 26 on the way to the return position, allowing the detection lever 26 to project into the transport passage. Through this movement, the driver mechanism 38 recognizes the arrival of the leading end of the photosensitive material 31 at the return position, and stops the backward rotation of the drive rollers 35, 36 to complete the pre-cut operation of the image recording device 32. Meanwhile, the winding core 11 does not rotate backward (i.e. in the rewind direction) in the paper rewind operation because the rewinding distance, from the cutter mechanism 70 to the return position, is considerably short. The photosensitive material 31 does not twine around the core but hangs inside the paper magazine 10.

When the print command is given to the image recording device 32, the driver mechanism 38 rotates the drive rollers 35, 36 to transport the photosensitive material 31, as described above. After transporting an intended amount of the photosensitive material 31 to the cutter mechanism 70, the driver mechanism 38 temporarily stops operating and the cutter mechanism 70 cuts the photosensitive material 31 into a sheet. At this instant, the leading end of the photosensitive material 31 is held with a transport roller pair 71 provided in the image recording device 32. The cutout sheet, a photosensitive material sheet 31*a*, is transported by the transport roller pair 71 to the subsequent recording section for image recording, and then, to the developing section for developing. This series of operations is repeated until the intended number of photosensitive material sheets 31*a* are transported with the transport roller pair 71 to the recording section.

When the photosensitive material 31 runs out, the detection lever 26 projects into the transport passage as shown by a dotted line in FIG. 3, and the driver mechanism 38 stops driving and indicates the running out of photosensitive material 31 externally. This indication can signal users to re-load the photosensitive material 31 in the paper magazine 10.

When the intended number of sheets are transported, the driver mechanism 38 rotates the drive rollers 35, 36 backward to rewind the photosensitive material 31 in the paper magazine 10. The leading end of the photosensitive material 31 thus moves from the cutting position of the cutter mechanism 70 back to the return position until the detection lever 26 projects into the transport passage. Then, the driver mechanism 38 stops the backward rotation. The leading end of the photosensitive material 31 will thus be held with the drive rollers 35, 36 and the flat belts 47, 48, which make pressure contact with each other.

Completely covered in the paper magazine 10 in this state, the leading end of the photosensitive material 31 is safe from exposure. In addition, in making the surface contact, not line contact, with the drive rollers 35, 36 and the flat belts 47, 48, the leading end of the photosensitive material 31 will be free from the linear nip impressions on the surfaces.

Although two pairs of the drive roller and the flat belt are aligned along the width of the photosensitive material 31 in the above embodiment, one pair or more than two pairs can be provided.

The orientation of the paper magazine 10 in the loading chamber 33 is not limited to the above embodiment where the flat belts 47, 48 lie below the drive rollers 35, 36. The paper magazine 10 may be mounted in the loading chamber 33 with the opening 34 facing up.

In the above embodiment, the photosensitive material 31 is not rolled up inside the paper magazine 10, but it is possible to rotate the winding core 11 backward only in the paper rewind operation to roll up the photosensitive material 31 around the roll core 20.

The pulleys 49, 50, 53, 54 are attached to the shafts 52, 55 through the roller bearings in the above embodiment. The pressing force also affects on the flat belts 47, 48, and thereby the shafts 52, 55 and the inner races of the roller bearings receive a radial load. The radial load can cause the roller bearings to slide, and possibly abrade the shafts 52, 55. It is therefore preferable to provide resin-made supports between the shafts 52, 55 and the inner races of the roller bearings so as to prevent the roller bearings from coming into direct contact with the shafts 52, 55.

Although the flat belts 47, 48 are respectively wound across the couples of pulleys 49, 53 and 50, 54 in the above embodiment, the pulleys for a single flat belt can be three or more in number.

In the above embodiment, the joint section 37 is provided on one end of the shaft 40 of the drive roller unit 25, and the driving force is applied from the outside of the paper magazine 10 through the joint section 37. However, the paper magazine 10 may incorporate a motor to rotate the drive rollers 35, 36.

As described so far, the present invention is not to be limited to the above embodiments, and all matter contained herein is illustrative and does not limit the scope of the present invention. Thus, obvious modifications may be made within the spirit and scope of the appended claims.

What is claimed is:

1. A paper magazine to nip and transport a roll of a recording paper, comprising:
- a plurality of pulleys separated by particular intervals;
- a belt for encircling said plurality of pulleys;
- a drive roller to make pressure contact with an outer surface of said belt for feeding said recording paper;
- a box-like magazine body with an open section, from which said recording paper roll being rotatably loaded;
- a lid for closing said open section; and
- a hinge for attaching said lid to said magazine body rotatably between a close position and an open position,
- wherein said pulleys and said belt are mounted on either one of joint portions of said paper magazine and said lid in said close position while said drive roller is mounted on the other.

2. The paper magazine as claimed in claim 1, wherein said belt and said drive roller are plural in number, and separately arranged along the width direction of said recording paper.

3. The paper magazine as claimed in claim 2, wherein said belts and said drive rollers hold said recording paper at a position not to hold side edges of said recording paper in the width direction.

4. The paper magazine as claimed in claim 3, further comprising:
- a tension applying mechanism for imparting tension of said belt to at least one of said plurality of pulleys.

5. The paper magazine as claimed in claim 4, wherein said belt is made of an elastic material, and is driven by said drive roller while bringing said recording paper into surface contact with said drive roller.

6. The paper magazine as claimed in claim 5, wherein said belt is a flat belt, and said pulleys have a crown shape surface.

7. The paper magazine as claimed in claim 6, wherein said drive roller is rotated by driving force from the outside of said paper magazine.

8. The paper magazine as claimed in claim 4,
- wherein said pulleys and said belt are mounted on said lid, and said drive roller is mounted on said magazine body.

9. The paper magazine as claimed in claim 8,
- wherein said belt and said drive roller are plural in number, and separately arranged along the width direction of said recording paper.

10. The paper magazine as claimed in claim 9, wherein said belts and said drive rollers hold said recording paper at a position not to hold side edges of said recording paper in the width direction.

11. The paper magazine as claimed in claim 10, further comprising:
- a tension applying mechanism for imparting tension of said belt to at least one of said plurality of pulleys.

12. The paper magazine as claimed in claim 11, wherein said belt is made of an elastic material, and is driven by said drive roller while bringing said recording paper into surface contact with said drive roller.

13. The paper magazine as claimed in claim 12, wherein said belt is a flat belt, and said pulleys have a crown shape surface.

14. The paper magazine as claimed in claim 13, further comprising:

shafts disposed parallel to said recording paper in the width direction, for supporting said drive roller and said pulleys; and a plurality of guide rollers attached to said shaft, separately arranged on outer sides of said drive roller and said pulleys.

15. The paper magazine as claimed in claim 14, further comprising:

a paper detection lever placed between said plural drive rollers, moving between a projecting position into a transport passage of said recording paper and a retreating position to which said paper detection lever is pushed from said projecting position by said recording paper in said transport passage; and a biasing member for biasing said paper detection lever to stay in said projecting position.

16. The paper magazine as claimed in claim 15, further comprising:

a paper guide disposed on one of said joint portion, placed upstream of said drive roller in a transport direction of said recording paper, being movable in the width direction of said recording paper, said paper guide being fixed at positions to contact with both ends in the width direction of plural kind of recording papers of different width, for regulating positions of said recording papers.

17. The paper magazine as claimed in claim 16, wherein said drive roller is rotated by driving force from the outside of said paper magazine.

* * * * *